US006814038B2

(12) United States Patent
Smith

(10) Patent No.: US 6,814,038 B2
(45) Date of Patent: Nov. 9, 2004

(54) SPOOL VALVE CONTROLLED VCT LOCKING PIN RELEASE MECHANISM

(75) Inventor: Franklin R. Smith, Cortland, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 10/603,637

(22) Filed: Jun. 25, 2003

(65) Prior Publication Data

US 2004/0055550 A1 Mar. 25, 2004

Related U.S. Application Data

(60) Provisional application No. 60/411,921, filed on Sep. 19, 2002.

(51) Int. Cl.[7] ..... F01L 1/34

(52) U.S. Cl. ..... 123/90.17; 123/90.15; 123/90.27; 123/90.16; 464/160

(58) Field of Search ..... 123/90.15, 90.16, 123/90.17, 90.18, 90.12, 90.27, 90.31; 464/1, 2, 160

(56) References Cited

U.S. PATENT DOCUMENTS

| | | | | |
|---|---|---|---|---|
| 5,002,023 A | | 3/1991 | Butterfield et al. | 123/90.17 |
| 5,107,804 A | | 4/1992 | Becker et al. | 123/90.17 |
| 5,172,659 A | | 12/1992 | Butterfield et al. | 123/90.17 |
| 5,184,578 A | | 2/1993 | Quinn, Jr. et al. | 123/90.17 |
| 5,289,805 A | | 3/1994 | Quinn, Jr. et al. | 123/90.17 |
| 5,361,735 A | | 11/1994 | Butterfield et al. | 123/90.17 |
| 5,386,807 A | * | 2/1995 | Linder | 123/90.17 |
| 5,497,738 A | | 3/1996 | Siemon et al. | 123/90.17 |
| 5,657,725 A | | 8/1997 | Butterfield et al. | 123/90.17 |
| 5,901,675 A | | 5/1999 | Nakagomi | 123/90.17 |
| 5,941,202 A | | 8/1999 | Jung | 123/90.17 |
| 6,247,434 B1 | | 6/2001 | Simpson et al. | 123/90.17 |
| 6,250,265 B1 | | 6/2001 | Simpson | 123/90.17 |
| 6,263,846 B1 | | 7/2001 | Simpson et al. | 123/90.17 |
| 6,311,655 B1 | | 11/2001 | Simpson et al. | 123/90.17 |
| 6,311,658 B2 | | 11/2001 | Eguchi | 123/90.17 |
| 6,374,787 B2 | | 4/2002 | Simpson et al. | 123/90.17 |
| 6,386,164 B1 | | 5/2002 | Mikame et al. | 123/90.17 |
| 6,477,996 B2 | * | 11/2002 | Ogawa | 123/90.15 |
| 6,477,999 B1 | | 11/2002 | Markley | 123/90.17 |
| 6,481,402 B1 | | 11/2002 | Simpson et al. | 123/90.17 |
| 6,526,930 B2 | * | 3/2003 | Takahashi et al. | 123/90.17 |
| 6,561,147 B2 | | 5/2003 | Takahashi et al. | 123/90.15 |
| 2002/0092489 A1 | | 7/2002 | Mikame et al. | 123/90.17 |

OTHER PUBLICATIONS

Gardner et al., Hybrid Multi–position Cam Indexer Having Controls Located in Rotor, US patent application, Pub. No. US 2003/0033998 A1, Feb. 20, 2003.*

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

A variable cam timing system that utilizes the same spool that controls the VCT mechanism to actively control the locking pin. The positions of the spool's multiple lands directly influences whether source oil is supplied to both the locking pin and either the retard or advance chamber of the phaser.

12 Claims, 7 Drawing Sheets

SPOOL VALVE CONTROLLED VCT LOCKING PIN RELEASE MECHANISM

REFERENCE TO RELATED APPLICATIONS

This application claims an invention which was disclosed in Provisional Application No. 60/411,921, filed Sep. 19, 2002, entitled "Spool Valve Controlled VCT Locking Pin Release Mechanism". The benefit under 35 USC §119(e) of the United States provisional application is hereby claimed, and the aforementioned application is hereby incorporated herein by reference.

BACKGROUND OF THE INVENTION

1. Field of the Invention

The invention is related to a hydraulic control system for controlling the operation of a variable camshaft timing (VCT) system. More specifically, the present invention relates to a control system utilized to lock and unlock a lock pin in a VCT phaser.

2. Description of Related Art

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes A camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6, 250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6, 263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is described. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a housing with one or more vanes, mounted to the end of the camshaft, surrounded by a housing with the vane chambers into which the vanes fit. It is possible to have the vanes mounted to the housing, and the chambers in the housing, as well. The housing's outer circumference forms the sprocket, pulley or gear accepting drive force through a chain, belt or gears, usually from the camshaft, or possibly from another camshaft in a multiple-cam engine.

Since the phasers cannot be perfectly sealed they are subject to oil loss through leakage. During normal engine operation, the oil pressure and flow generated by the engine oil pump is generally sufficient to keep the phaser full of oil and fully functional. However, when the engine is shut down, the oil can leak from the VCT mechanism. During engine start conditions, before the engine oil pump generates oil pressure, the lack of controlling oil pressure in the chambers can allow the phaser to oscillate excessively due to lack of oil, producing noise and possibly damaging the mechanism. Additionally, it is desirable to have the phaser locked in a particular position while the engine is attempting to start.

One solution employed in prior art phasers is to introduce a locking pin that will lock the phaser in a specific phase angle position relative to the crankshaft when insufficient oil exists in the chambers. These locking pins are typically spring loaded to engage and are released using engine oil pressure. Therefore, when the engine is shut down and engine oil pressure reaches some predetermined low value such that the spring-loaded pin will engage and lock the phaser. During engine start up, the pin remains engaged until the engine oil pump generates enough pressure to release the pin.

Other solutions employed in the prior art have separate hydraulic paths, lines, or hydraulic control systems to activate the locking pin, these separate hydraulic paths, lines, and systems may be controlled by separate spool valves or by an electric or electro-magnetic locking mechanism.

It is desirable to form a VCT system that uses the same spool valve that controls the VCT mechanism to actively control the locking pin as well. In other words, a variable cam timing system that utilizes a spool valve for controlling the VCT mechanism can be actively used to control a locking pin. Furthermore, the positions of the spool's multiple lands directly influences whether source oil is supplied to both the locking pin and either the retard or advance chamber of the phaser.

SUMMARY OF THE INVENTION

In a VCT system, a mechanism is provided that uses the same spool valve for controlling the VCT mechanism as well as actively controlling a lock pin.

In a VCT system with a phaser having a center positioned control valve, additional passages are provided. The additional passages are first, a passage for communicating source oil that is in common with the source oil that fills the VCT mechanism system; second, a passage that directs oil to and from the locking pin; and third, the passage that is a vent which allows oil to flow from the locking pin back to the supply sump.

An additional land is provided on the spool for controlling the additional passages.

Accordingly, a VCT mechanism is provided for adjusting and maintaining an angular relationship between a cam shaft and a crank shaft or another shaft using a pressurized fluid, the VCT mechanism having a phaser using the pressurized fluid for adjusting and maintaining the angular relationship, the pressurized fluid flows from a fluid source to a fluid sink the VCT mechanism comprises: a locking pin being disposed to engage a recess, wherein the pressurized fluid is allowed to flow therein, to thereby disengage the locking pin from the recess; a spool valve controlling the flow of the pressurized fluid for adjusting and maintaining the angular relationship, and an extra land disposed to control the timing of the pressurized fluid flowing from the fluid source toward the recess and from the recess toward the fluid sink; and a set of passages disposed to have fluid flowing therein. the set of passages includes: a first passage disposed to have fluid flowing therein, the first passage having a first end disposed to be in fluid communication with the fluid source and a second end; a second passage disposed to have fluid flowing therein, the second passage having a first end disposed to be in fluid communication with the second end of the first passage, the second passage further having a second end in fluid communication with the recess; and a third passage disposed to have fluid flowing therein, the third passage having a first end disposed to be in fluid communication with the first end of the second passage, the third passage further having a second end in fluid communication with the fluid sink.

DETAILED DESCRIPTION OF THE INVENTION

Internal combustion engines have employed various mechanisms to phase the angle of the camshaft relative to the crankshaft for improved engine performance or reduced emissions. One of these mechanisms is of the Variable Camshaft Timing (VCT) mechanism type. The majority of these Variable Camshaft Timing (VCT) mechanisms are operated using engine oil as the working fluid. Since most of the VCT mechanisms are not 100% sealed they are subject to oil loss through leakage. During normal engine operation, the oil pressure and flow generated by an engine oil pump is generally sufficient to keep the VCT full of oil and thereby filly functional. However, when the engine is shutdown, the oil can tends to leak from the VCT mechanism. Therefore, during subsequent engine start conditions, the VCT may oscillate excessively due to lack of oil pressure within the VCT system.

Figure 1A:
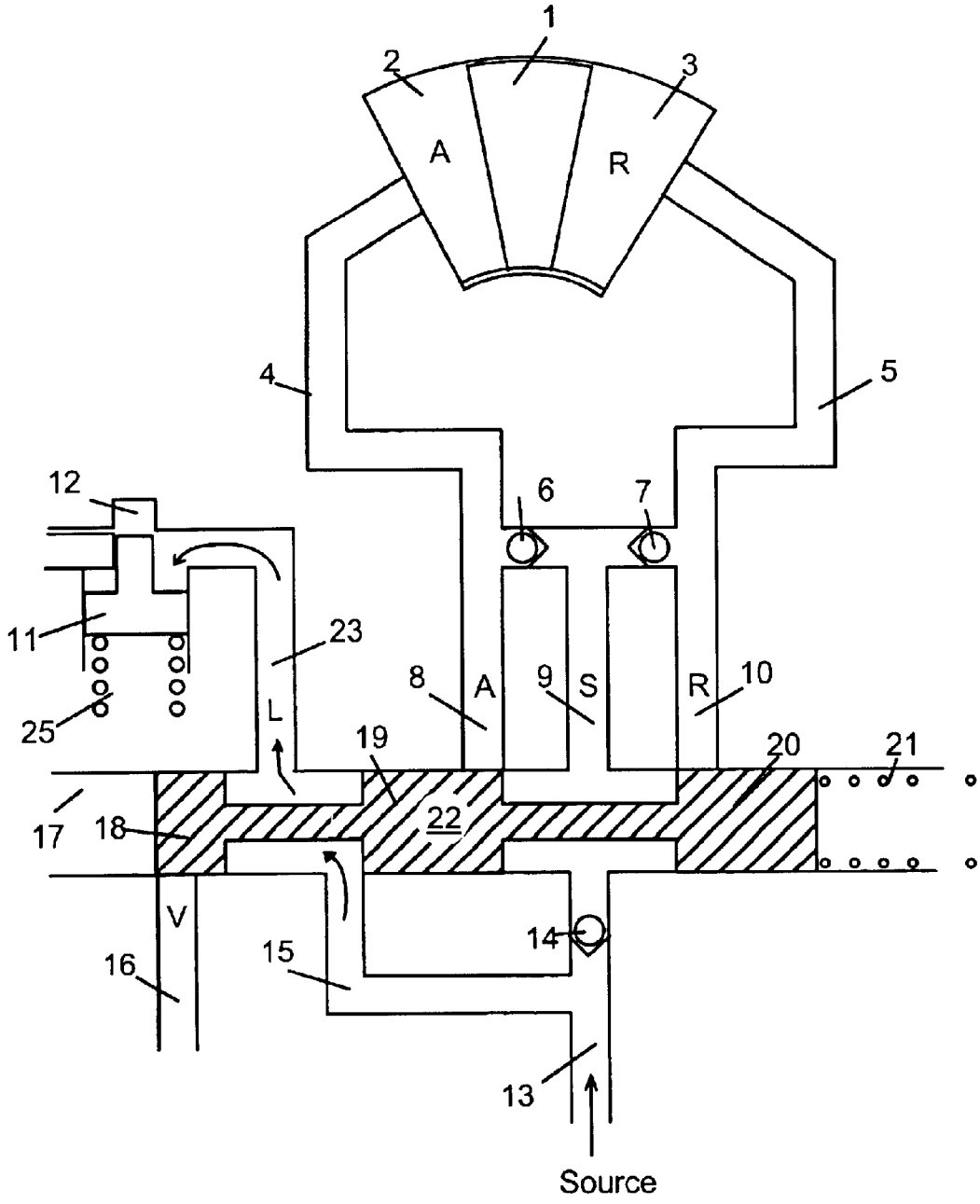
FIGS. 1*a*, 1*b*, 1*c*, and 1*d* shows an embodiment of the present invention.
Figure 1B:
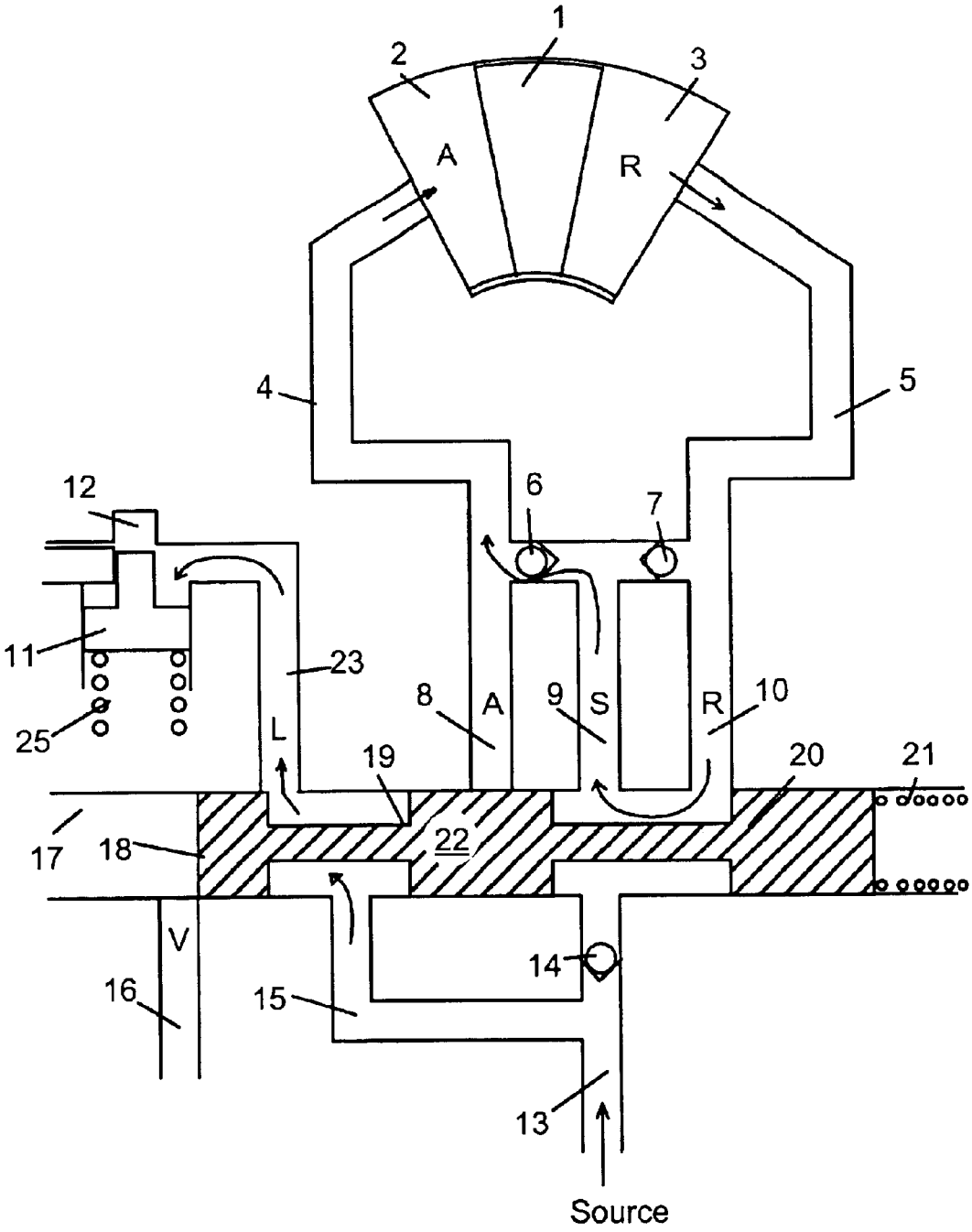
Figure 1C:
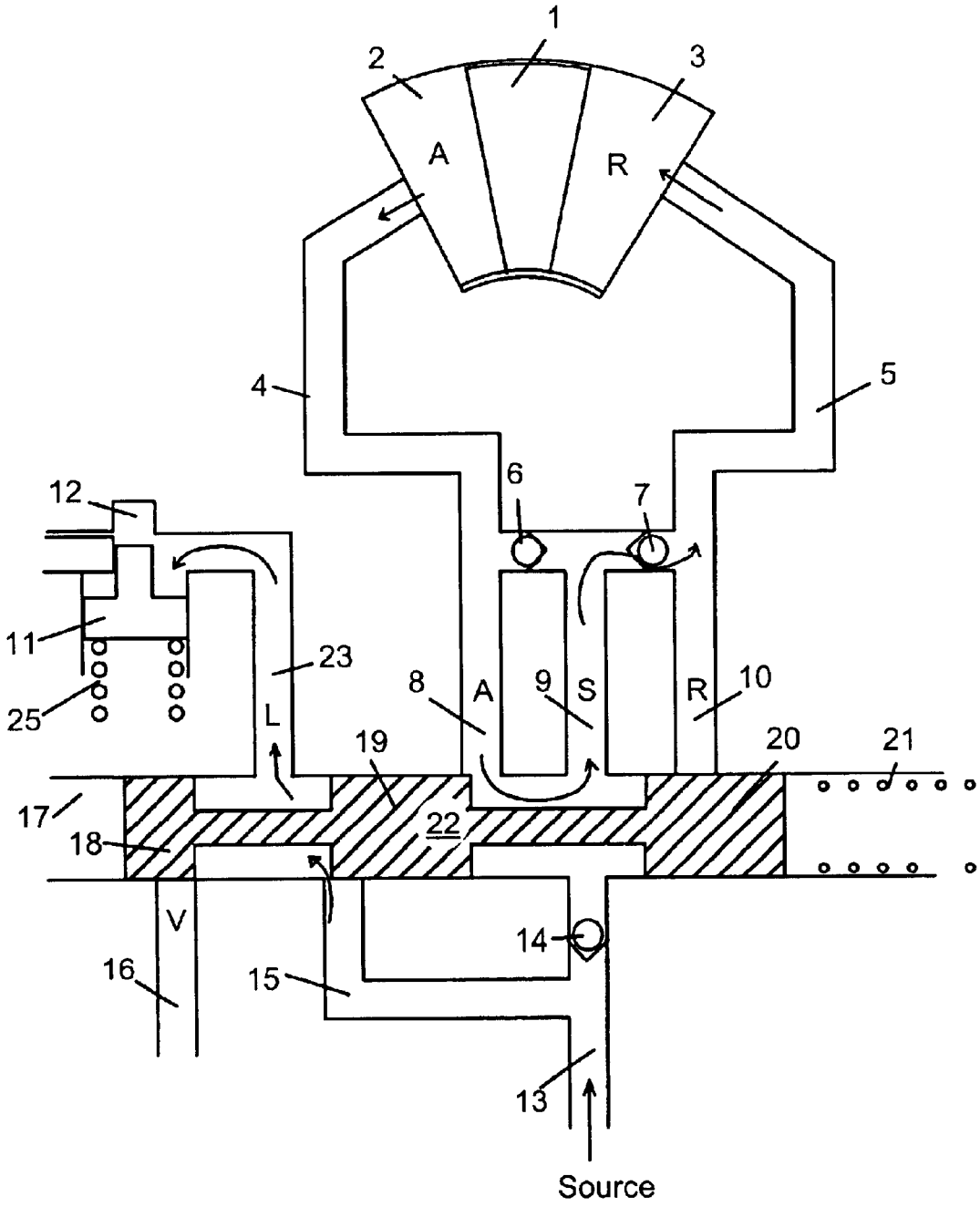
Figure 1D:
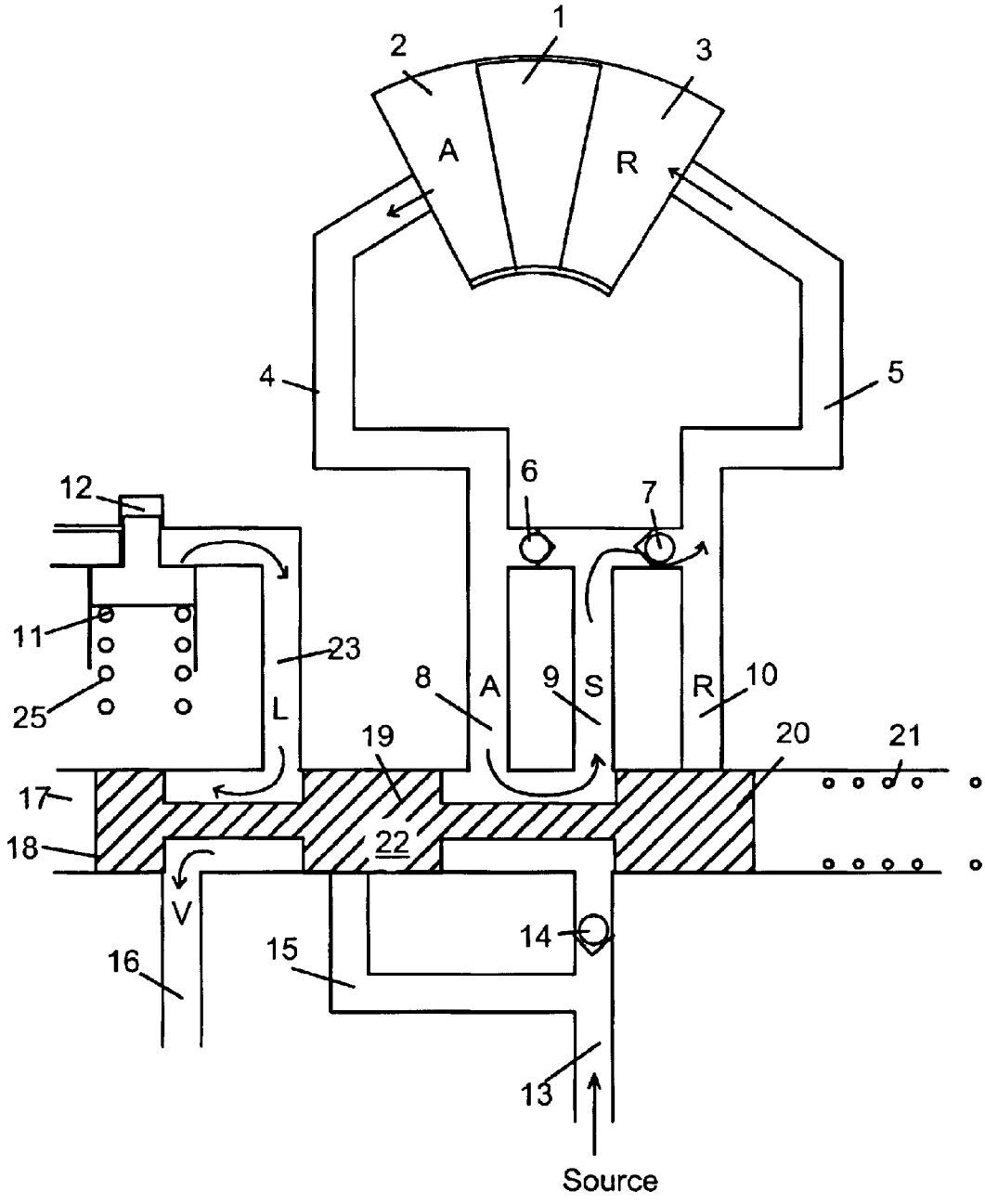

FIGS. 1*a* to 1*d* show the control system of the present invention in the following positions: null (FIG. 1*a*), advance (FIG. 1*b*), retard with locking pin released (FIG. 1*c*) and retard with locking pin engaged (FIG. 1*d*). In each of the figures, a cylindrical spool (22), having three lands (18)(19)(20), rides in bore (17). The engine oil supply (13) is routed to the bore (17) through passage (14), which has a check valve therein, and a first passage (15) which is in direct fluid communication with a source of oil such as engine oil supply (13). It is noted that the source of oil provides means for normal VCT mechanism. In other words, without the first passage (15), engine oil supply (13) still maintains oil supply for the VCT mechanism. First passage (15) branches off engine oil supply (13) for implementing the present invention. Passage (16) vents to the engine oil sump (not shown). A second passage L or lock passage (23) leads to a lock pin (11) which is disposed to fit into a recess (12) to thereby locking the phaser in position. Second passage L (23) is used for directing oil to and from the lacking pin. A third passage (16) forms a vent which vents the circulating oil within the VCT system to an engine oil sump (not shown). One of the functions of the third passage (16) is to allow oil to flow from the locking pin (11) region back to the oil sump or oil supply sump.

Passage (8) leads to advance chamber A (2), and passage (10) similarly leads to retard chamber R (3). The two chambers are separated by a vane (1) which forms part of the phaser. In a "cam torque actuated" (CTA) phaser of the kind shown in FIGS. 1*a*–1*d*, passage 5 (9), with check valves (6) and (7), provides a recycling line to allow actuated fluid to pass from A to R, or R to A. The direction of the actuated fluid depends on the position of the spool valve, in the manner described in U.S. Pat. No. 5,107,804, entitled VARIABLE CAMSHAFT TIMING FOR INTERNAL COMBUSTION ENGINE which is hereby incorporated herein by reference. It will be understood by one skilled in the art, however, that the system of the invention can be used in phasers which are directly energized or moved by oil pressure, hybrid arrangements, or any other arrangements which uses a single spool valve to control the phaser.

Referring back to FIG. 1*a*, the spool (22) is in the null position. The first land (18) blocks the vent passage or the third passage (16) that disallows source oil to drain from the locking pin (11). The second land (19) blocks source oil from the advance branch line (8) and the third land (20) blocks source oil from the retard branch line (10). The makeup source oil supplied to the spool and subsequently the branch lines is supplied via a supply line containing a check valve (14) to prevent the return of oil from the spool (22) into the source during pressure pulses due to torque reversals.

With both the advance and retard branch lines (8)(10) blocked, source oil can only travel towards the advance and retard chambers (2)(3) through the source branch line (9) to make up for oil lost to leakage. The source branch line (9) ends in a cross-section marked by check valves (6)(7). Again, with both the advance and retard branch lines (8)(10) blocked, neither check valve (6)(7) is closed, thereby allowing source oil to go through both the advance and retard lines (4)(5). This way, both the advance and retard chambers (2)(3) are kept filled with oil. However, oil cannot flow from advance chamber A to retard chamber R, or vice versa. Thereby vane (1) is effectively locked in position. As can be seen, with the spool (22) in this position, i.e. null position, the source oil still freely supplies oil to the locking pin (11) via a supply line or first passage (15), thereby forcing the locking pin (11) to remain disengaged from the recess (12).

FIG. 1*b* shows the spool (22) in the advanced or advancing position. The second land (19) blocks the advance branch line (8) from exhausting from advance chamber A. The third land (20) no longer blocks the retard branch line (10), thereby allowing source oil and oil that is being drained from the retard chamber (3) to flow through the source branch line (9) and the check valve (6) adjacent to the to the advance line (4), to fill up the advance chamber (2), simultaneously allowing cam torque reversals to move the vane (1) accordingly. Similar to FIG. 1*a*, source oil is still being supplied to the locking pin (11), thereby maintaining the locking pin (ii) disengaged from recess (12).

FIG. 1*c* shows the spool in a retard position or retarding position, with the locking pin disengaged. The amount of oil supplied to the locking pin (11) is still adequate in quantity to keep the locking pin (11) from engaging recess (12). The third land (20) completely blocks the retard branch line (10). The source oil and the oil draining from the advance chamber (2) through the branch line (4) combine and flow through the source branch line (9) through the check valve (7) adjacent to the retard branch line (10), into the retard chamber (3), thereby allowing cam torque reversals to move the vane toward the retard position. Similar to FIGS. 1*a* and 1*b*, source oil is still being supplied to the locking pin (11), thereby maintaining the locking pin (11) disengaged from recess (12).

FIG. 1*d* shows the spool (22) in the retard position, with the locking pin engaged. The first land (18) no longer blocks the vent passage (16). The second land (19) now blocks the supply line (15) of source oil that was maintaining the locking pin (11) in a disengaged position; and no longer blocks the advance branch line (8) from source oil. The third land (20) now blocks the retard branch line (10) from the source oil. With the lands (18)(19)(20) in these specific positions, source oil flows through the check valve (14) into the bore (17) containing the spool (22). The source oil in combination with the oil draining from the advance chamber (2) move through the check valve (7) adjacent to the retard branch line (10) to fill the retard chamber (3) and move vane (1) accordingly. The locking pin (11) engages recess (12), since the supply of oil is no longer present and the remaining oil is drained off through the vent passage or third passage (16).

It is understood that the locking pin (11) could disengage the rotor when the VCT mechanism is in the retard and null state, and the locking pin (11) could engage the rotor when the VCT mechanism in the advanced state, as within the teachings of the invention, by reversing the positions of land (18) and passages (15), (16) and L (23) on the other end of the spool. As can be seen by referring to FIGS. 1*a*–1*d*, pin (11) is counter balanced by an elastic element (25) biased upon or engaging an opposite end in relation to the end which is in fluid contact with oil within the second passage L (23). The force exerted by the elastic element (25) is substantially constant. Further, elastic element (25) may be a spring, or more specifically, a metal spring.

Figure 2:
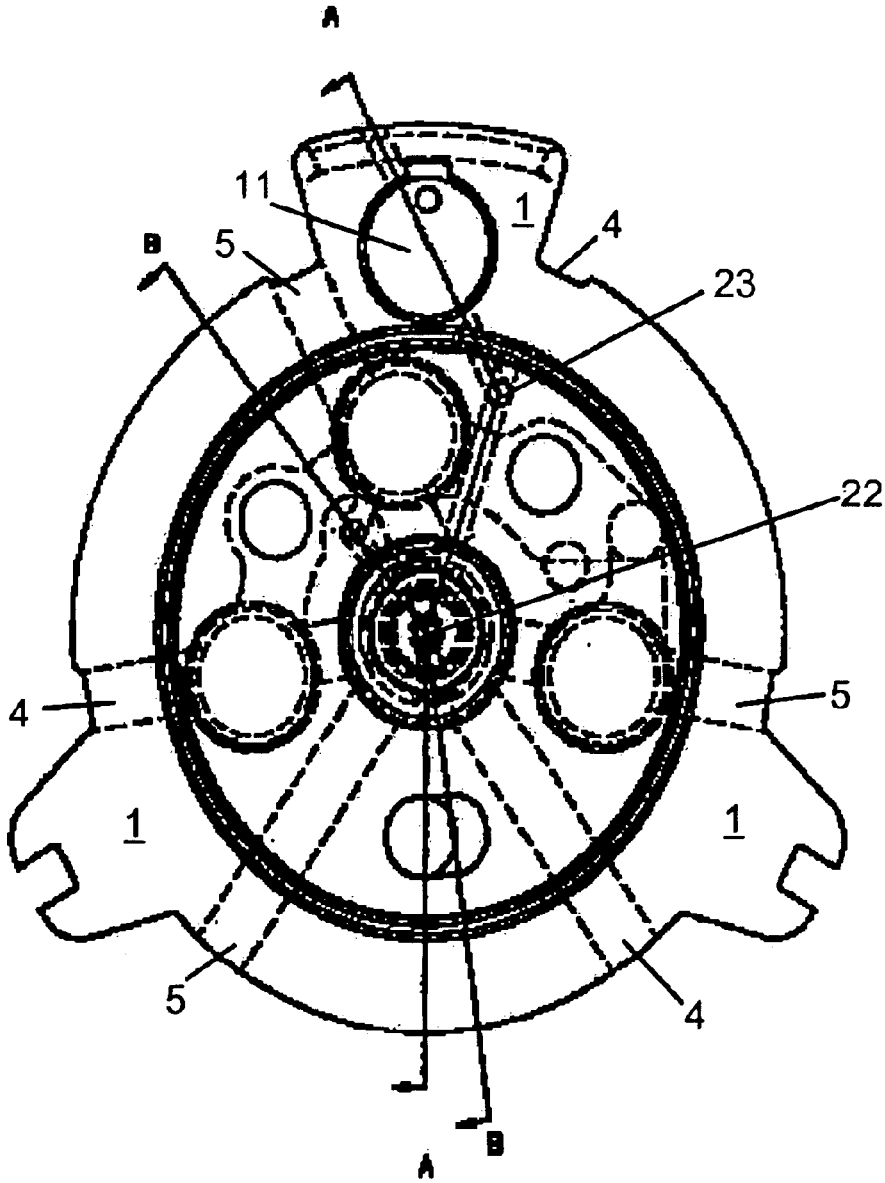
FIG. 2 shows a cross-sectional view of the VCT phaser having a lock pin with inlet and outlet passages connected thereto.
Figure 3:
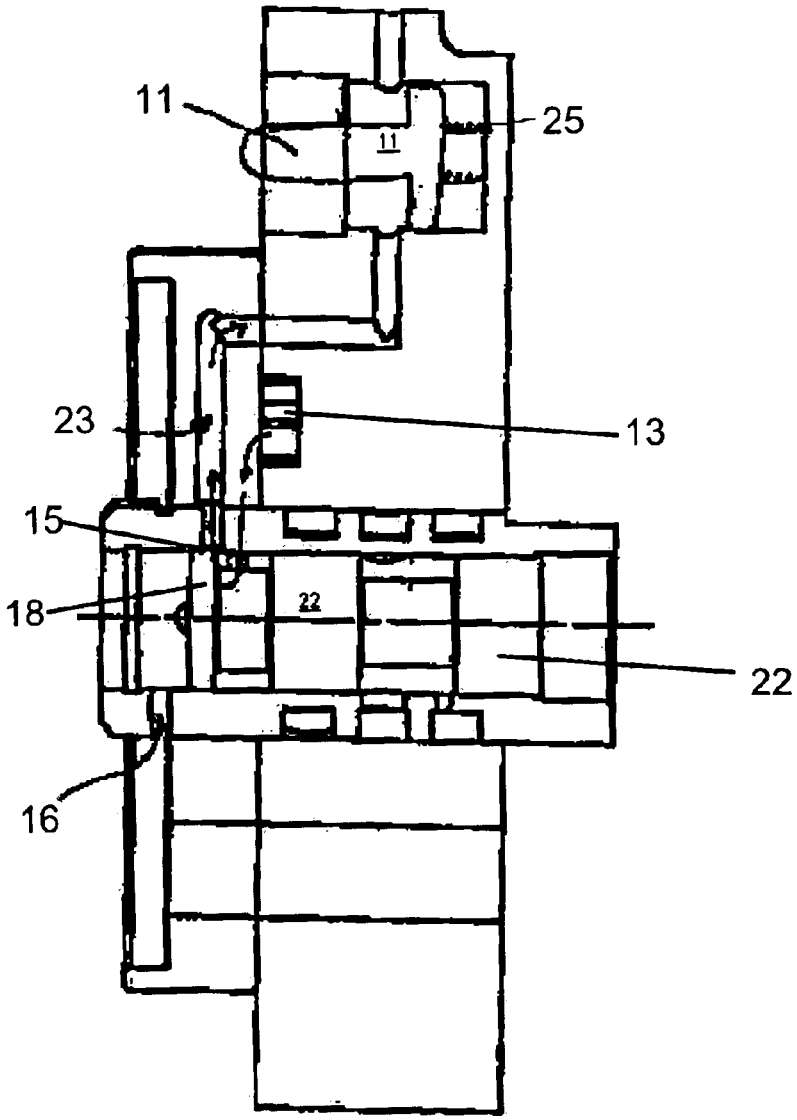
FIG. 3 shows a cross-sectional view taken along line A—A in FIG. 2.
Figure 4:
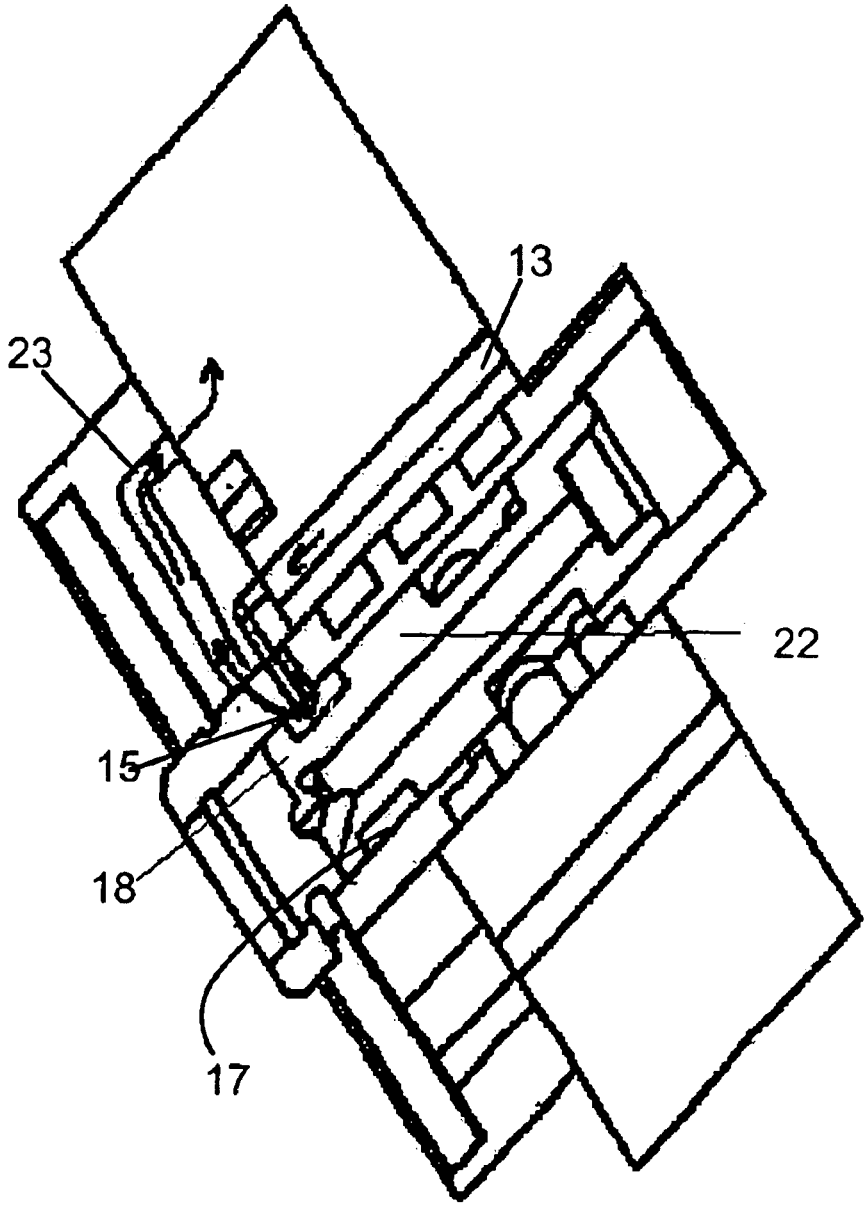
FIG. 4 is a cross-sectional view taken along line B—B in FIG. 2.

FIG. 2 shows a cross-sectional view of a phaser. FIGS. 3 and 4 show cross-sectional views along lines A—A and B—B of FIG. 2. In general the figures show how the control system of the invention can be fitted into a cam phaser of the type having a spool valve in the center of the rotor. The spool in turn has an extra land 18 for controlling energized fluid which flows to and from the proximity of lock pin 11 including passage 23 and passage 16.

Referring to FIG. 2, a face view of portions of a phaser of the present invention is shown. More specifically, FIG. 2 shows locking pin 11 and passages L(23) to/from the locking pin 11 in face view. A rotor that oscillates within a housing (not shown) in which three Vanes (1) being circumferentially extended therefrom and formed thereon is shown. At the center of rotor is a circumferential openings of a substantially cylindrical shape that permits spool 22 to move therein. 2 sets of holes each set comprising of the same is provided. Further, note the second passage L (23) facilitates fluid communication between the source (not shown) and the pin (11). In addition, passages (4) and (5) functions as described in FIGS. 1*a*–1*d*.

Referring to FIG. 3, a cross-sectional view along line A—A of FIG. 2 is shown. More specifically, FIG. 3 is a cross section that shows the lock pin passage L (23) and the vent passage V16. Source (13) supplies oil and spool valve (22) is slidably positioned at the center of the rotor (4). Lock vent passage (16) channels out excessive oil.

Referring FIG. 4, cross-sectional views along line B—B of FIG. 2 is shown. More specifically, FIG. 4 is a cross section that shows the lock pin passage L (23) and the source passage (13) and passage (15). Spool (22) controllably moves or slides at the center of rotor (4) and is limited by bore (17).

The following is an example that shows the function of the present invention which uses only one or rather a single spool valve (as opposed to separate spool valves for controlling the vane (1) and controlling the lock pin (11) respectively) is that when the spool valve (22) moves out it simultaneously commands or accomplishes two functions. First, "spool out" commands the VCT or phaser to move to a stop. This stop can be either full advance or full retard depending on the layout of hydraulic passages. By locating the locking pin (11) at the full advance or full retard stop the VCT system then automatically finds the locked position. The second command is to turn off the source oil and vent the locking pin (11) via vent passage (16) thereby allowing lock pin (11) to extend into and engage recess (12).

As can be appreciated, compared with known VCT lock systems that use separate spool valves for controlling hydraulic passages, and compared with known VCT lock systems that uses source oil pressure for locking and unlocking a phaser without routing the source oil via the proximity of a single spool such as the center positioned spool (22) as shown in the present invention, both function can be performed more efficiently. In other words, the present invention provides only one spool valve (22) to perform the above two functions (i.e. phase the VCT to a position and engage the lock) as can seen in FIGS. 1*a*–1*d*.

The present invention further provides a unique feature that combines the above two functions. This feature can be portrayed, for example, by referring back to FIGS. 1*a*–1*d*. For instance when the spool valve (22) is moving out and crosses null the first command based on spool position is to move the VCT to the locked position. The second command occurs after the spool valve moves out further. So the sequence of events when the spool valve (22) is moving out is to relocate the VCT first and then locking pin (11) second. When the spool valve is moved "in", the staging of events is reversed. The first little movement of the spool valve first unlocks the VCT, even before the spool valve reaches null. After moving in past null the VCT then can move off the locked position. This is desirous because if you command the VCT to move before the locking pin is disengaged one tends to wedge the locking pin in place and not be able to unlock the VCT via the actuating force against the pin. As can be seen, the present invention forestalls control strategies that need to give the VCT enough time to release before commanding it away from the locked position.

Another desirous result of the present invention is that when the spool valve is moved in then the first action to occur is to disengage the lock pin (11). This occurs even before the spool valve (22) moves far enough to command the VCT to move.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Camber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A VCT mechanism for adjusting and maintaining an angular relationship between a cam shaft and a crank shaft or another shaft using a pressurized fluid, the VCT mechanism having a phaser using the pressurized fluid for adjusting and maintaining the angular relationship, the pressurized fluid flows from a fluid source to a fluid sink, the VCT mechanism comprising:

a locking pin being disposed to engage a recess, wherein the pressurized fluid is allowed to flow therein, to thereby disengage the locking pin from the recess;

a spool valve controlling the flow of the pressurized fluid for adjusting and maintaining the angular relationship, and an extra land disposed to control the timing of the pressurized fluid flowing from the fluid source toward the recess and from the recess toward the fluid sink; and a set of independent passages being substantially independent of passages for maintaining fluid communication between at least one advance chamber and at least one retard chamber disposed to have fluid flowing therein, the set of passages including:

a first passage disposed to have fluid flowing therein, the first passage having a first end disposed to be in fluid communication with the fluid source and a second end;

a second passage disposed to have fluid flowing therein, the second passage having a first end disposed to be in fluid communication with the second end of the first passage, the second passage further having a second end in fluid communication with the recess; and a third passage disposed to have fluid flowing therein, the third passage having a first end disposed to be in fluid communication with the first end of the second passage, the third passage further having a second end in fluid communication with the fluid sink.

2. The VCT mechanism of claim 1, wherein the spool valve is disposed to control the fluid communication between the first end of the second passage and the second end of the first passage.

3. The VCT mechanism of claim 1, wherein the spool valve is disposed to control the fluid communication between the first end of the second passage and the first end of the third passage.

4. The VCT mechanism of claim 1, wherein the spool valve is a center mounted spool valve disposed to be within the phaser.

5. The VCT mechanism of claim 1, wherein the another shaft is a cam or crank shaft.

6. The VCT mechanism of claim 1, wherein the VCT mechanism is a CTA VCT system.

7. In a VCT mechanism for adjusting and maintaining an angular relationship between a cam shaft and a crank shaft or another shaft using a pressurized fluid, the VCT mechanism having a phaser using the pressurized fluid for adjusting and maintaining the angular relationship, the pressurized fluid flows from a fluid source to a fluid sink, a method comprising the steps of:

providing a locking pin being disposed to engage a recess, wherein the pressurized fluid is allowed to flow therein, to thereby disengage the locking pin from the recess;

providing a spool valve controlling the flow of the pressurized fluid for adjusting and maintaining the angular relationship, and an extra land disposed to control the timing of the pressurized fluid flowing from the fluid source toward the recess and from the recess toward the fluid sink;

providing a set of independent passages being substantially independent of passages for maintaining fluid communication between at least one advance chamber and at least one retard chamber disposed to have fluid flowing therein, the set of passages including:

a first passage disposed to have fluid flowing therein, the first passage having a first end disposed to be in fluid communication with the fluid source and a second end;

a second passage disposed to have fluid flowing therein, the second passage having a first end disposed to be in fluid communication with the second end of the first passage, the second passage further having a second end in fluid communication with the recess; and a third passage disposed to have fluid flowing therein, the third passage having a first end disposed to be in fluid communication with the first end of the second passage, the, third passage further having a second end in fluid communication with the fluid sink; and based upon the positioning of the extra land, disengaging the lock pin immediately before unlocking the VCT mechanism for fluid communication between at least one advance chamber and at least one retard chamber.

8. The method of claim 7, wherein the spool valve is disposed to control the fluid communication between the first end of the second passage and the second end of the first passage.

9. The method of claim 7, wherein the spool valve is disposed to control the fluid communication between the first end of the second passage and the first end of the third passage.

10. The method of claim 7, wherein the spool valve is a center mounted spool valve disposed to be within the phaser.

11. The method of claim 7, wherein the another shaft is a cam or crank shaft.

12. The method of claim 7, wherein the VCT mechanism is a CTA VCT system.

* * * * *

UNITED STATES PATENT AND TRADEMARK OFFICE

CERTIFICATE OF CORRECTION

PATENT NO. : 6,814,038 B2
DATED : November 9, 2004
INVENTOR(S) : Franklin R. Smith It is certified that error appears in the above-identified patent and that said Letters Patent is hereby corrected as shown below:

Column 5,
Lines 39 and 43, delete the word "housing" and add the word -- rotor --.

Signed and Sealed this

Eighth Day of March, 2005

JON W. DUDAS
*Director of the United States Patent and Trademark Office*